US005400064A

United States Patent [19]

Pies et al.

[11] Patent Number: 5,400,064

[45] Date of Patent: Mar. 21, 1995

[54] HIGH DENSITY INK JET PRINTHEAD WITH DOUBLE-U CHANNEL ACTUATOR

[75] Inventors: John R. Pies; David B. Wallace, both of Dallas; Donald J. Hayes, Plano, all of Tex.

[73] Assignee: Compaq Computer Corporation, Houston, Tex.

[21] Appl. No.: 859,671

[22] Filed: Mar. 30, 1992

Related U.S. Application Data

[63] Continuation-in-part of Ser. No. 746,036, Aug. 16, 1991, abandoned, and a continuation-in-part of Ser. No. 746,521, Aug. 16, 1991, Pat. No. 5,227,813, and a continuation-in-part of Ser. No. 748,220, Aug. 16, 1991, Pat. No. 5,235,352.

[51] Int. Cl.[6] ..... B41J 2/045

[52] U.S. Cl. ..... 347/68; 347/40; 347/69; 347/71

[58] Field of Search ..... 347/68, 69, 71, 40

[56] References Cited

U.S. PATENT DOCUMENTS

| | | | |
|---|---|---|---|
| 3,857,049 | 12/1974 | Zoltan | 310/328 |
| 4,536,097 | 8/1985 | Nilsson | 400/126 |
| 4,584,590 | 4/1986 | Fischbeck et al. | 346/69 |
| 4,825,227 | 4/1989 | Fischbeck et al. | 346/69 |
| 4,879,568 | 11/1989 | Bartky et al. | 346/69 |
| 4,887,100 | 12/1989 | Michaelis et al. | 346/69 |
| 4,963,882 | 10/1990 | Hickman | 346/1.1 |
| 5,016,028 | 5/1991 | Temple | 346/69 |
| 5,227,813 | 7/1993 | Pies et al. | 347/69 |
| 5,235,352 | 8/1993 | Pies et al. | 347/69 |
| 5,252,994 | 10/1993 | Narita et al. | 347/71 |
| 5,302,976 | 4/1994 | Sugahara et al. | 347/69 |

FOREIGN PATENT DOCUMENTS

| | | | |
|---|---|---|---|
| 0 364 136 | 4/1990 | European Pat. Off. . | |
| 0 402 172 | 12/1990 | European Pat. Off. . | |
| 0485241 | 5/1992 | European Pat. Off. | B41J 2/045 |
| 3 820 082 | 12/1988 | Germany . | |

OTHER PUBLICATIONS

Wallace, David B, "A Method of Characteristic Model of a Drop-on-Demand Ink-Jet Device Using an Integral Method Drop Formation Model," 89-WF/FE-4 (1989).

*Primary Examiner*—Matthew S. Smith

*Attorney, Agent, or Firm*—Konneker Bush Hitt & Chwang

[57] ABSTRACT

An ink jet printhead includes of a lower body part having a base section and a plurality of generally parallel spaced projections extending upwardly therefrom and an upper body part having a top section and a corresponding plurality of generally parallel spaced projections extending downwardly therefrom. The top sides of the lower body projections are conductively mounted to the bottom sides of the upper body projections to form sidewalls which define a plurality of ink-carrying channels. Strips of a conductive adhesive mount the lower and upper body projections together and a controller is electrically connected to the strips to selectively impart either a positive, zero, or negative voltage to each strip. The lower body part is formed using a piezoelectric material poled in a first direction generally perpendicular to the channels and the upper body part is formed using a piezoelectric material also poled in the first direction. By applying a positive voltage to a first strip of conductive adhesive and a negative voltage to an adjacent strip of conductive adhesive, first and second electric fields oppositely orientated to each other and normal to the direction of poling are produced in the lower and upper body projections which form first and second sidewalls for the channel, thereby causing the first and second sidewalls to deform in first and second channel expanding directions, respectively.

21 Claims, 8 Drawing Sheets

HIGH DENSITY INK JET PRINTHEAD WITH DOUBLE-U CHANNEL ACTUATOR

CROSS REFERENCE TO RELATED APPLICATIONS

This application is a continuation-in-part of Ser. Nos. 07/746,036, now abandoned, 07/746,521, now U.S. Pat. No. 5,227,813, and 07/748,220, now U.S. Pat No. 5,235,352, each of which were filed on Aug. 16, 1991, assigned to the assignee of the present application and hereby incorporated by reference as if reproduced in their entirety.

BACKGROUND OF THE INVENTION

1. Field of the Invention

The invention relates to a high density ink jet printhead and, more particularly, to a high density ink jet printhead having double-U actuators for firing ink-carrying channels axially extending therethrough.

2. Description of Related Art

Printers provide a means of outputting a permanent record in human readable form. Typically, a printing technique may be categorized as either impact printing or non-impact printing. In impact printing, an image is formed by striking an inked ribbon placed near the surface of the paper. Impact printing techniques may be further characterized as either formed-character printing or matrix printing. In formed-character printing, the element which strikes the ribbon to produce the image consists of a raised mirror image of the desired character. In matrix printing, the character is formed as a series of closely spaced dots which are produced by striking a provided wire or wires against the ribbon. Here, characters are formed as a series of closely spaced dots produced by striking the provided wire or wires against the ribbon. By selectively striking the provided wires, any character representable by a matrix of dots can be produced.

Non-impact printing is often preferred over impact printing in view of its tendency to provide higher printing speeds as well as its better suitability for printing graphics and half-tone images. Non-impact printing techniques include matrix, electrostatic and electrophotographic type printing techniques. In matrix type printing, wires are selectively heated by electrical pulses and the heat thereby generated causes a mark to appear on a sheet of paper, usually specially treated paper. In electrostatic type printing, an electric arc between the printing element and the conductive paper removes an opaque coating on the paper to expose a sublayer of a contrasting color. Finally, in electrophotographic printing, a photoconductive material is selectively charged utilizing a light source such as a laser. A powder toner is attracted to the charged regions and, when placed in contact with a sheet of paper, transfers to the paper's surface. The toner is then subjected to heat which fuses it to the paper.

Another form of non-impact printing is generally classified as ink jet printing. Ink jet printing systems use the ejection of tiny droplets of ink to produce an image. The devices produce highly reproducible and controllable droplets, so that a droplet may be printed at a location specified by digitally stored image data. Most ink jet printing systems commercially available may be generally classified as either a "continuous jet" type ink jet printing system where droplets are continuously ejected from the printhead and either directed to or away from the paper depending on the desired image to be produced or as a "drop on demand" type ink jet printing system where droplets are ejected from the printhead in response to a specific command related to the image to be produced.

Continuous jet type ink jet printing systems are based upon the phenomena of uniform droplet formation from a stream of liquid issuing from an orifice. It had been previously observed that fluid ejected under pressure from an orifice about 50 to 80 microns in diameter tends to break up into uniform droplets upon the amplification of capillary waves induced onto the jet, for example, by an electromechanical device that causes pressure oscillations to propagate through the fluid. For example, in FIG. 1, a schematic illustration of a continuous jet type ink jet printer 10 may now be seen. Here, a pump 12 pumps ink from an ink supply 14 to a nozzle assembly 16. The nozzle assembly 16 includes a piezo crystal 18 which is continuously driven by an electrical voltage supplied by a driver 20. The pump 12 forces ink supplied to the nozzle assembly 16 to be ejected through a nozzle 22 in a continuous stream. The continuously oscillating piezo crystal 18 creates pressure disturbances that cause the continuous stream of ink to break-up into uniform droplets of ink and acquire an electrostatic charge due to the presence of an electrostatic field, often referred to as the charging field, generated between electrodes 24 by a charge driver 25. Using high voltage deflection plates 26, the trajectory of selected ones of the electrostatically charged droplets can be controlled to hit a desired spot on a sheet of paper 28. The high voltage deflection plates 26 also deflect unselected ones of the electrostatically charged droplets away from the sheet of paper 28 and into a reservoir 30 for recycling purposes. Due to the small size of the droplets and the precise trajectory control, the quality of continuous jet type ink jet printing systems can approach that of formed-character impact printing systems. However, one drawback to continuous jet type ink jet printing systems is that fluid must be jetting even when little or no printing is required. This requirement degrades the ink and decreases reliability of the printing system.

Due to this drawback, there has been increased interest in the production of droplets by electromechanically induced pressure waves. In this type of system, a volumetric change in the fluid is induced by the application of a voltage pulse to a piezoelectric material which is directly or indirectly coupled to the fluid. This volumetric change causes pressure/velocity transients to occur in the fluid and these are directed so as to produce a droplet that issues from an orifice. Since the voltage is applied only when a droplet is desired, these types of ink jet printing systems are referred to as "drop-on-demand" type systems. For example, in FIG. 2, a drop on demand type ink jet printer 32 is schematically illustrated. A nozzle assembly 34 draws ink from a reservoir (not shown). A driver 36 receives character data and actuates piezoelectric material 38 in response thereto. For example, if the received character data requires that a droplet of ink be ejected from the nozzle assembly 34 to form a desired character, the driver 36 will apply a voltage to the piezoelectric material 38, thereby causing the piezoelectric material 38 to act as a transducer. The piezoelectric material 38 will deform in a manner that forces the nozzle assembly 34 to eject a droplet of ink from an orifice 40. The ejected droplet will then strike a sheet of paper 42.

The use of piezoelectric materials in ink jet printers is well known. Most commonly, piezoelectric material is used in a piezoelectric transducer by which electric energy is converted into mechanical energy by applying an electric field across the material, thereby causing the piezoelectric material to deform. This ability to distort piezoelectric material has often been utilized in order to force the ejection of ink from the ink-carrying channels of an ink jet printhead. One such ink jet printhead configuration which utilizes the distortion of a piezoelectric material to eject ink includes a tubular piezoelectric transducer which surrounds an ink-carrying channel. When the transducer is excited by the application of an electrical voltage pulse, the ink-carrying channel is compressed and a drop of ink ejected from the channel. For example, an ink jet printhead which utilizes circular transducers may be seen by reference to U.S. Pat. No. 3,857,045 to Zoltan. However, the relatively complicated arrangement of the piezoelectric transducer and the associated ink-carrying channel causes such devices to be relatively time-consuming and expensive to manufacture.

In order to reduce the per ink-carrying channel (or "jet") manufacturing cost of an ink jet printhead, in particular, those ink jet printheads having a piezoelectric actuator, it has long been desired to produce an ink jet printhead having a channel array in which the individual channels which comprise the array are arranged such that the spacing between adjacent channels is relatively small. For example, it would be very desirable to construct an ink jet printhead having a channel array where adjacent channels are spaced between approximately four and eight mils apart. Such a ink jet printhead is hereby defined as a "high density" ink jet printhead. In addition to a reduction in the per ink-carrying channel manufacturing cost, another advantage which would result from the manufacture of an ink jet printhead with a high channel density would be an increase in printer speed. However, the very close spacing between channels in the proposed high density ink jet printhead has long been a major problem in the manufacture of such printheads.

Recently, the use of shear mode piezoelectric transducers for ink jet printhead devices have become more common. For example, U.S. Pat. Nos. 4,584,590 and 4,825,227, both to Fischbeck et al., disclose shear mode piezoelectric transducers for a parallel channel array ink jet printhead. In both of the Fischbeck et al. patents, a series of open ended parallel ink pressure chambers are covered with a sheet of piezoelectric material along their roofs. Electrodes are provided on opposite sides of the sheet of piezoelectric material such that positive electrodes are positioned above the vertical walls separating pressure chambers and negative electrodes are positioned over the chamber itself. When an electric field is provided across the electrodes, the piezoelectric material, which is polled in a direction normal to the electric field direction, distorts in a shear mode configuration to compress the ink pressure chamber. In these configurations, however, much of the piezoelectric material is inactive. Furthermore, the extent of deformation of the piezoelectric material is small.

An ink jet printhead having a parallel channel array and which utilizes piezoelectric materials to construct the sidewalls of the ink-carrying channels may be seen by reference to U.S. Pat. No. 4,536,097 to Nilsson. In Nilsson, an ink jet channel matrix is formed by a series of strips of a piezoelectric material disposed in spaced parallel relationships and covered on opposite sides by first and second plates. One plate is constructed of a conductive material and forms a shared electrode for all of the strips of piezoelectric material. On the other side of the strips, electrical contacts are used to electrically connect channel defining pairs of the strips of piezoelectric material. When a voltage is applied to the two strips of piezoelectric material which define a channel, the strips become narrower and higher such that the enclosed cross-sectional area of the channel is enlarged and ink is drawn into the channel. When the voltage is removed, the strips return to their original shape, thereby reducing channel volume and ejecting ink therefrom.

An ink jet printhead having a parallel ink-carrying channel array and which utilizes piezoelectric material to form a shear mode actuator for the vertical walls of the channel has also been disclosed. For example, U.S. Pat. Nos. 4,879,568 to Bartky et al. and 4,887,100 to Michaelis et al. each disclose an ink jet printhead channel array in which a piezoelectric material is used as the vertical wall along the entire length of each channel forming the array. In these configurations, the vertical channel walls are constructed of two oppositely polled pieces of piezoelectric material mounted next to each other and sandwiched between top and bottom walls to form the ink channels. Once the ink channels are formed, electrodes are then deposited along the entire height of the vertical channel wall. When an electric field normal to the poling direction of the pieces of piezoelectric material is generated between the electrodes, the vertical channel wall distorts to compress the ink jet channel in a shear mode fashion.

SUMMARY OF THE INVENTION

In one embodiment, the present invention is an ink jet printhead having a lower body part and an upper body part, both formed from a piezoelectric material. The lower body part includes a base section and a plurality of generally parallel spaced projections extending longitudinally along the base section and upwardly therefrom. Similarly, the upper body part includes a top section and a corresponding plurality of generally parallel spaced projections extending longitudinally along the top section and downwardly therefrom. The top sides of the lower body projections are conductively mounted to the bottom sides of the upper body projections to define a plurality of generally parallel, axially extending ink-carrying channels. In one aspect of this embodiment of the invention, the lower body part is poled in a first direction generally perpendicular to the direction of axial extension of the plurality of parallel channels and, in another aspect, the upper body part is also poled in the first direction. In other aspects of this embodiment of the invention, strip-shaped sections of a layer of conductive adhesive may be used to mount the lower and upper body projections together and a controller may be electrically connected to the strips to selectively impart either a positive, zero, or negative voltage to each of the strip-shaped sections of the layer of conductive adhesive.

In another embodiment, the present invention is of an ink jet printhead comprised of a first generally U-shaped actuator having first and second top surfaces and a second generally U-shaped actuator having first and second bottom surfaces conductively mounted to the first and second top surfaces of the first generally U-shaped actuator to define a elongated liquid confining channel therebetween. In one aspect of this embodiment of the invention, means for electrically connecting the first and second U-shaped actuators for the selective application of a first pressure pulse to the elongated liquid confining channel is provided. In another aspect, the ink jet printhead further includes a first strip of conductive adhesive for conductively mounting the first top surface of the first U-shaped actuator to the first bottom surface of the second U-shaped actuator and a second strip of conductive adhesive to conductively mount the second top surface of the second U-shaped actuator to the second bottom surface of the second U-shaped actuator. In yet another aspect of this embodiment of the invention, means for selectively applying a positive voltage to the first strip of conductive adhesive and means for selectively applying a negative voltage to the second strip of conductive adhesive are also provided.

In still yet another aspect of this embodiment of the invention, the first U-shaped actuator may be formed using a piezoelectric material poled in a first direction generally perpendicular to the direction of the elongated liquid confining channel and the second U-shaped actuator may be formed from a piezoelectric material also poled in the first direction. By applying a positive voltage to the first strip of conductive adhesive and a negative voltage to the second strip of conductive adhesive, first, second, third and fourth electric fields are produced. The electric fields cause a first sidewall of the liquid confining channel to deform in a first direction which expands the channel and a second sidewall of the channel to deform in a second direction which also expands the channel.

BRIEF DESCRIPTION OF THE DRAWINGS

The present invention may be better understood, and its numerous objects, features and advantages will become apparent to those skilled in the art by reference to the accompanying drawing, in which.

DETAILED DESCRIPTION OF A PREFERRED EMBODIMENT

Figure 3:
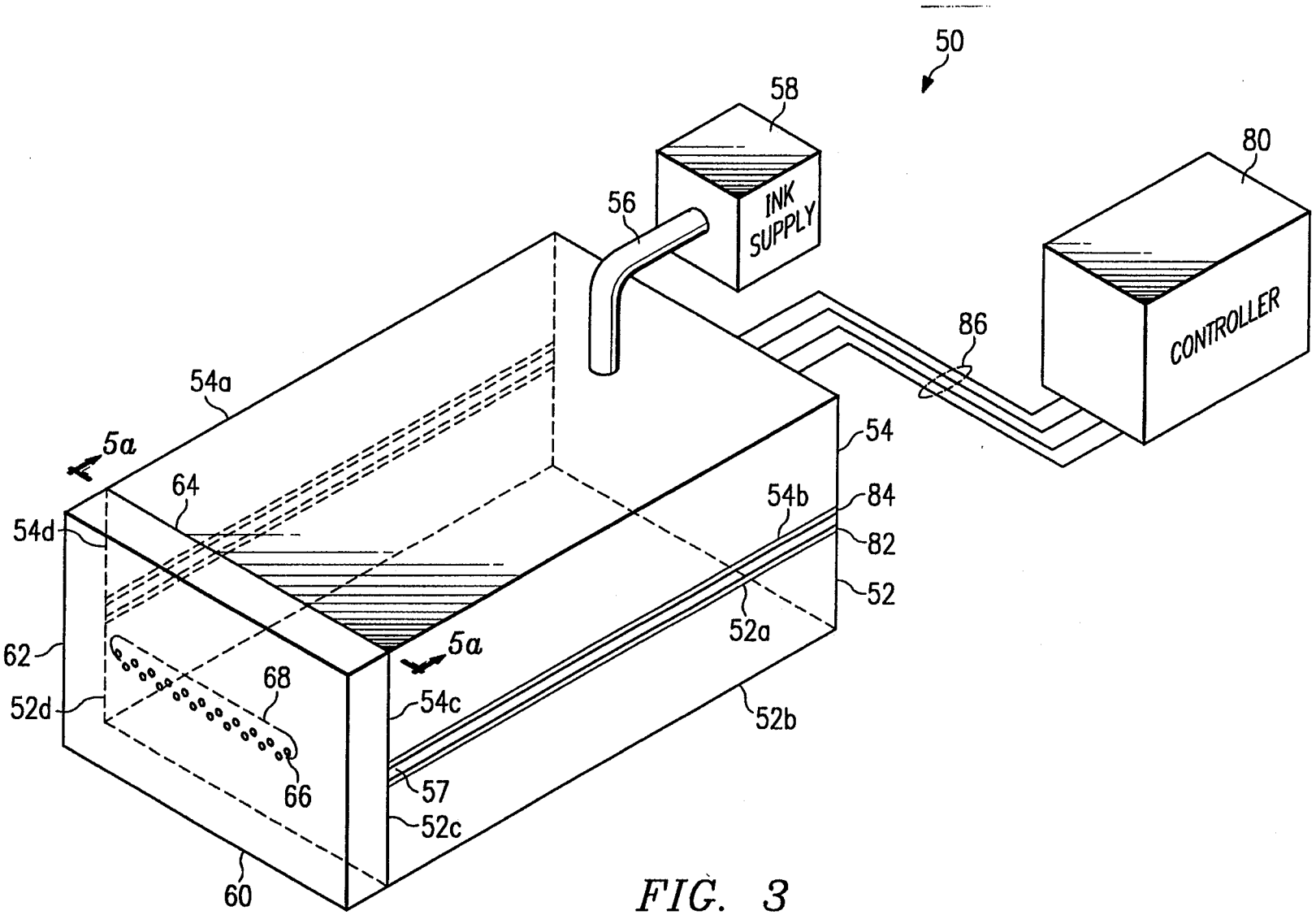
FIG. 3 is a perspective view of a schematically illustrated ink jet printhead constructed in accordance with the teachings of the present invention.

Referring now to the drawing wherein thicknesses and other dimensions have been exaggerated in the various figures as deemed necessary for explanatory purposes and wherein like reference numerals designate the same or similar elements throughout the several views, in FIG. 3, an ink jet printhead 50 constructed in accordance with the teachings of the present invention may now be seen. The ink jet printhead 50 includes similarly dimensioned lower and upper body parts 52, 54, each having respective top and bottom surfaces 52*a*, 52*b* and 54*a*, 54*b*. Formed onto each of the surfaces 52*a* and 54*b*, respectively, is a metallized conductive surface 82, 84 which is more fully described below. The lower and upper body parts 52, 54 are aligned, mated and bonded together by a layer 57 of conductive adhesive which bonds the metallized conductive surfaces 82, 84 to each other.

A plurality of laterally extending grooves of predetermined width and depth are formed through the lower body part 52 and the upper body part 54 such that, when the two parts are joined together, a plurality of pressure chambers or ink-carrying channels (not visible in FIG. 3) are formed, thereby producing a channel array for the ink jet printhead 50. Prior to assembly, a manifold (also not visible in FIG. 3) in communication with the channels is formed near the rear portion of the ink jet printhead 50. Preferably, the manifold is comprised of a channel extending through the upper body part 54 in a direction generally perpendicular to the channels. As to be more fully described below, the manifold communicates with an external ink conduit 56 to provide means for supplying ink to the channels from a source of ink 58 connected to the external ink conduit 56.

To form the ink jet printhead illustrated in FIG. 3, first and second generally rectangular blocks formed from a piezoelectric material and having similar dimensions are required. To form one such block, powdered piezoelectric material is pressed into the desired generally rectangular shape. Once pressed into the desired shape, the piezoelectric material is then fired and the surfaces smoothed by conventional grinding techniques to form the desired generally rectangular block of piezoelectric material. Preferably, lead zirconate titante (or "PZT") is the piezoelectric material selected to form the blocks of piezoelectric material. It should be clearly understood, however, that other, comparable, piezoelectric materials could be used to manufacture the ink jet printhead disclosed herein without departing from the scope of the present invention.

Figure 5A:
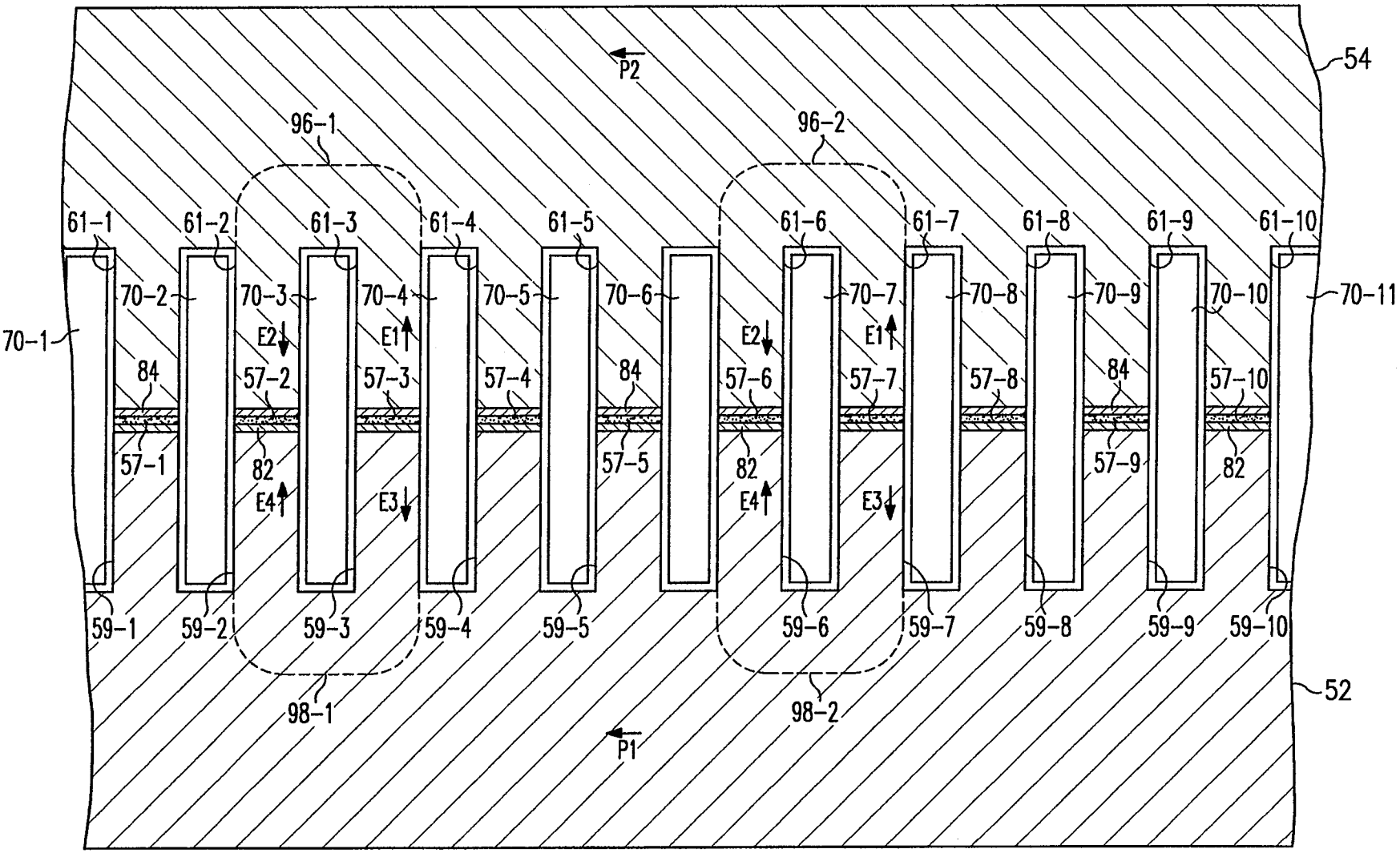
FIG. 5*a* is an enlarged, partial cross-sectional view taken along lines 5*a*—5*a* of the schematically illustrated ink jet printhead of FIG. 3 and which illustrates an unactuated parallel channel array of the ink jet printhead.

The rectangular block of piezoelectric material is then polarized in a selected direction. To polarize the rectangular block, opposing surfaces are first metallized by applying, for example, by a deposition process, respective layers of a conductive metallic material thereon. Next, a high voltage of a predetermined value is applied between the metallic layers to polarize the rectangular block. The direction of polarization produced thereby corresponds to the direction of the voltage drop between the metallic layers. After polarization is complete, the metallic layers are removed by conventional means. For the lower body part 52, side surfaces 52*c* and 52*d* should be metallized and a positive voltage applied to the side surface 52*c*, thereby polarizing the lower body part 52 in direction p1(see FIG. 5*a*). Conversely, for the upper body part 54, side surfaces 54*c* and 54*d* should be metallized and a positive voltage applied to the side surface 54*c*, thereby polarizing the upper body part 54 in direction p2 (see FIG. 5*a*).

After the polarization process is complete, the upper surface 52*a* of lower body part 52 and the lower surface 54*b* of the upper body part 54 are metallized to form respective metallized conductive surfaces 82, 84. In the preferred embodiment, the metallization process would be accomplished by depositing a layer of a nichrome-gold alloy on each of the surfaces 52*a* and 54*b*. It should be clearly understood, however, that the aforementioned deposition process is but one manner in which a layer of conductive material may be applied to the surfaces 52*a*, 54*b* and that numerous other conductive materials and/or processes would be suitable for use herein.

Next, a machining process is then commenced to form the aforementioned series of grooves in each of the upper and lower body parts 52, 54. Starting at the metallized conductive surface 82 deposited on the upper surface 52*a* of the lower body part 52 and the metallized conductive surface 84 deposited on the lower surface 54*b* of the upper body part 54, respectively, a series of axially extending, substantially parallel grooves which extend across the entire length of the lower and upper body parts 52, 54, respectively, in a direction generally perpendicular to the respective poling directions p1, p2, of the lower and upper body parts 52, 54 are formed. The grooves should extend downwardly through the metallized conductive surfaces 82, 84, respectively, and partially through the lower and upper body parts 52, 54, respectively, and be formed in a manner so that the grooves of the lower and upper body parts 52, 54 are alignable during mating. If desired, the grooves of the lower and upper body parts may be formed simultaneously. Next, a layer 57 of conductive adhesive such as epoxy or other suitable conductive adhesive is applied to the lower body part 52 and the remaining portions of the metallized conductive surface 82 of the lower body part 52 are conductively mounted to the remaining portions of the metallized conductive surface 84 of the upper body part 54. Typically, the layer 57 of conductive adhesive would be kept very thin, most likely on the order of about two tenths to one-half of a mil in thickness and would only be applied to the remaining portions of the metallized conductive surface 82, thereby forming a series of strip-shaped sections of conductive adhesive. The grooves formed in the lower and upper body parts 52 may then be coated with a thin layer 63 of a dielectric material and then mated and bonded together, for example, by using flip-chip bonding equipment such as that manufactured by Research Devices. Alternately, bonding between the remaining portions of the metallized conductive surface 82 of the lower body part 52 and the metallized conductive surface 84 of the upper body part 54 may be achieved by soldering the metallized conductive surfaces 82, 84 to each other, thereby eliminating the need for a conductive adhesive.

It is contemplated that, in accordance with one embodiment of the invention, the metallized conductive surfaces 84, 86 may be eliminated entirely while maintaining satisfactory operation of the high density ink jet printhead 50, so long as the surface 54*b* of the upper body part 54 and the surface 52*a* of the lower body part 52 are conductively mounted together and a voltage may be readily applied to the layer 57 of conductive adhesive provided therebetween. Thus, in one embodiment of the invention, it is contemplated that a single layer 57 of conductive adhesive is utilized to conductively mount the surfaces 52*a* and 54*b* to each other. It should be noted, however, that the use of solder would not be available for use when the metallized conductive surfaces 82, 84 have been eliminated.

In this manner, the present invention of an ink jet printhead 50 having a channel array comprised of a plurality of parallel channels 70, each of which has first and second generally U-shaped actuators associated therewith for both defining the axially extending walls of the channel and for firing the channel by producing ink ejecting pressure pulses therein.

Continuing to refer to FIG. 3, the ink jet printhead 50 further includes a front wall 60 having a front side 62, a back side 64 and a plurality of tapered orifices 66 extending therethrough. The back side 64 of the front wall 60 is aligned, mated and bonded with the upper and low body portions 52, 54 such that each orifice 66 is in communication with a corresponding one of the plurality of channels formed by the joining of the upper and lower body portions 52, 54, thereby providing ink ejection nozzles for the channels. Preferably, each orifice 66 should be positioned such that it is located at the center of the end of the corresponding channel. It should be clearly understood, however, that the ends of each of the channels could function as orifices for the ejection of drops of ink in the printing process without the necessity of providing the front wall 60 and the orifice 66. It is further contemplated that the dimensions of the orifice array 68 comprised of the orifices 66 could be varied to cover various selected lengths along the front wall 60 depending on the channel requirements of the particular ink jet printhead 50 envisioned. For example, in one configuration, it is contemplated that the orifice array 68 would be approximately 0.064 inches in height and approximately 0.193 inches in length and be comprised of about twenty-eight orifices 66 provided in a staggered configuration where the centers of adjacent orifices 66 would be approximately 0.0068 inches apart.

The channels are actuated by a controller 80 such as a microprocessor or other integrated circuit which supplies a voltage signal to various ones of the strip-shaped sections forming the layer 57 of conductive adhesive using a corresponding number of control lines 86, four of which are shown in FIG. 3 for illustrative purposes. Each line 86 is connected to one of the strip-shaped sections of the layer 57 of conductive adhesive so that a desired voltage pattern to be more fully described below may be imparted to the first and second U-shaped actuators provided for each channel 70 of the ink jet printhead 50. The controller 80 operates the ink jet printhead 50 by transmitting a series of positive and/or negative voltages to selected ones of the strip-shaped sections of the layer 57 of conductive adhesive. The supplied voltages will cause the first and second U-shaped drivers which form the axially extending walls of a channel 70 to deform in a certain direction.

Thus, by selectively placing selected voltages on the strip-shaped sections of conductive adhesive which separate the first and second U-shaped drivers for a channel 70, the channel may be selectively "fired", i.e., caused to eject ink, in a given pattern, thereby producing a desired image. The exact configuration of a pulse sequence for selectively firing the channels may be varied without departing from the teachings of the present invention. For example, a suitable pulse sequence may be seen by reference to the article to Wallace, David B., entitled "A Method of Characteristic Model of a Drop-on-Demand Ink-Jet Device Using an Integral Method Drop Formation Model", 89-WA/FE-4 (1989). In its most general sense, the pulse sequence for an actuator consists of a positive going (or "+") segment which causes the actuator to impart an expansive pressure pulse into the channel being fired thereby and a negative going (or "−") segment which causes the actuator to impart a compressive pressure pulse, timed to reinforce the expansive pressure pulse which has been reflected and inverted by a boundary, for example, the boundary formed by first and second blocks 76, 78 of composite material, into the channel. Finally, it should be noted that, while, in the embodiment of the invention disclosed herein, the controller 80 is illustrated as being positioned at a remote location, it is contemplated that, in various alternate embodiments, the controller 80 may be mounted on a rearward extension of the lower body part 52 or on the top or side of the assembled ink jet printhead 50.

Figure 1:
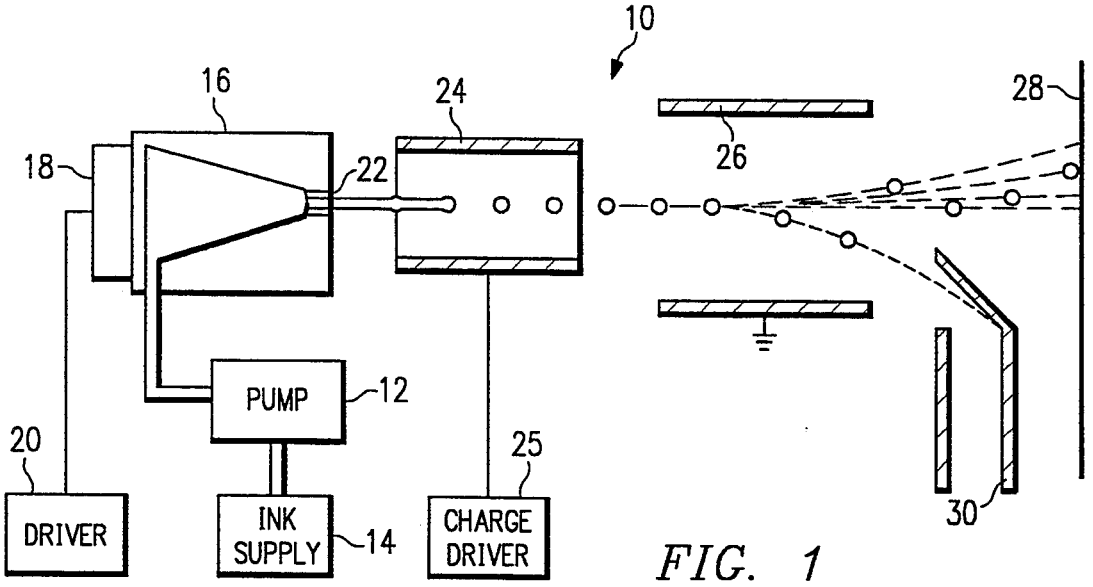
FIG. 1 is a schematic illustration of a continuous jet type ink jet printhead.
Figure 2:
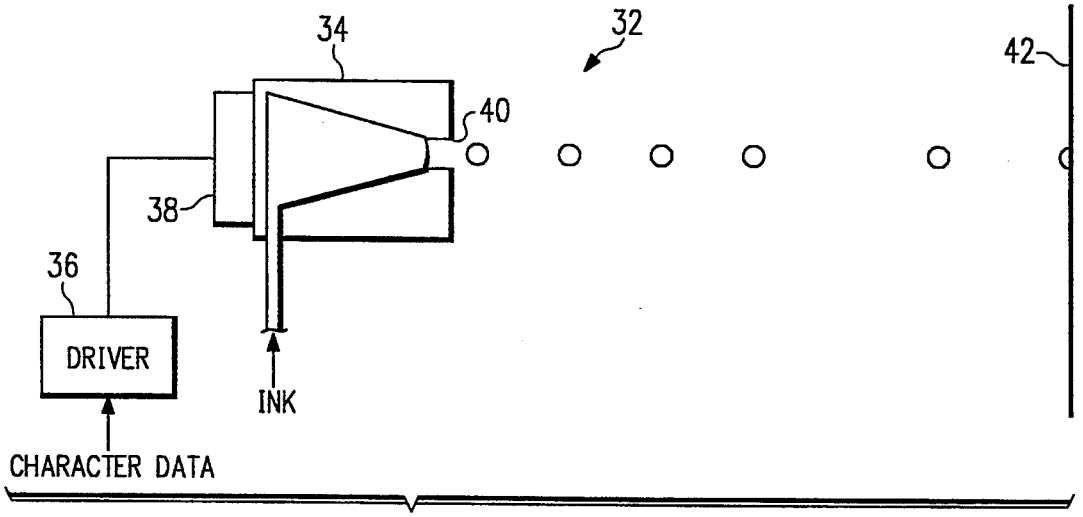
FIG. 2 is a schematic illustration of a drop-on-demand type ink jet printhead.
Figure 4:
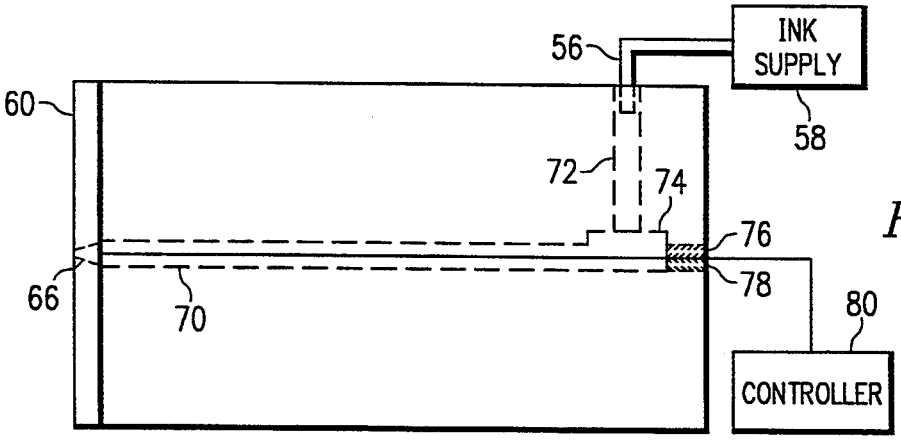
FIG. 4 is a side view of the schematically illustrated ink jet printhead of FIG. 3.

Referring next to FIG. 4, a side elevational view of the high density ink jet printhead 50 which better illustrates the means for supplying ink from a source of ink 58 to the channels 70 may now be seen. Ink stored in the ink supply 58 is supplied via the external ink conduit 56 to an internal ink-carrying channel 72 which extends vertically through the entire upper body part 54. The vertically extending ink-carrying channel 72 may be positioned anywhere in the upper body part 54 of the ink jet printhead 50 although, in the preferred embodiment of the invention, the vertically extending ink-carrying channel 72 extends through the general center of the upper body part 54. Ink supplied through the vertically extending ink-carrying channel 72 is transmitted to a manifold 74 extending generally perpendicular to and in communication with each of the channels 70. The manifold 74 is produced by forming a horizontally extending channel along the lower surface **54*b* which communicates with each channel 70 and the vertically extending ink-carrying channel 72. Finally, while the channels 70, when formed, extend the entire length of the ink jet printhead 50, a first block 76 and second block 78, each formed of a composite material, blocks the back end of the upper and lower portions of the channels 70 so that ink supplied to the channels 70 shall, upon actuation of the channel 70, be propagated in the forward direction where it exits the ink jet printhead 50 through a corresponding one of the tapered orifices 66**.

Referring next to FIG. **5*a*, a parallel channel array comprised of a plurality of channels 70-1, 70-2, 70-3, 70-4, 70-5, 70-6, 70-7, 70-8, 70-9, 70-10 and 70-11, each of which axially extends through the ink jet printhead 50 and is actuatable by first and second U-shaped actuators, may now be seen. It should be noted that the number of parallel channels illustrated is purely exemplary and that the ink jet printhead 50 may include any number of parallel channels 70. As may be seen here, grooves formed in the lower and upper body parts 52, 54 form a series of lower body projections 59-1, 59-2, 59-3, 59-4, 59-5, 59-6, 59-7, 59-8, 59-9, 59-10 and upper body projections 61-1, 61-2, 61-3, 61-4, 61-5, 61-6, 61-7, 61-8, 61-9, 61-10 which are then bonded together by a stripshaped section 57-1, 57-2, 57-3, 57-4, 57-5, 57-6, 57-7, 57-8, 57-9, 57-10 of the layer 57 of conductive material to form the channels of the channel array. For example, the channel 70-3 is defined by a first sidewall formed by the combination of the projection 59-2, the strip-shaped section 57-2 and the projection 61-2, a section of the top body part 54, a second sidewall formed by the combination of the projection 59-3, the strip-shaped section 57-3 and the projection 61-3 and a section of the lower body part 52. The interior of each channel 70-1 through 70-10 is coated with a layer 63 of dielectric material having a generally uniform thickness of between approximately 2 and 10 micrometers. Preferably, the channels 70-1 through 70-10 are coated with the dielectric layer 63 after the lower and upper body parts 52, 54** are grooved and before the two are mounted together.

By forming the channels of a parallel channel array in the manner herein described, an ink jet printhead in which each channel is actuatable by a pair of generally U-shaped actuators, the first U-field actuator being formed by the portion of the lower body part 52 which defines the channel and the second U-field actuator being formed by the portion of the upper body part 54 which defines the same channel, is produced. For example, the channel 70-3 is actuatable by a first generally U-shaped actuator 96-1 and a second generally U-shaped actuator 98-1.

The strip-shaped sections 57-1 through 57-10 are connected to the controller 80 so that either a positive or negative voltage pulse may be applied thereto. To activate the ink jet printhead 50 by selectively firing one or more of the channels 70-1 through 70-10, the controller 80 responds to an input image signal representative of an image desired to be printed and applies voltages of predetermined magnitude and polarity to certain ones of the strip-shaped sections 57-1 through 57-10 of the layer 57 of conductive adhesive, thereby creating electric fields which will deflect the sidewalls of those channels 70-1 through 70-10 which must be fired in order to produce the desired image. For example, if a negative voltage is applied to the strip-shaped section 57-2 and a positive voltage is applied to the strip-shaped section 57-3, an electric field e1 generally perpendicular to the direction of polarization p1 is established between the strip-shaped section 57-3 and the top body part 54 and an electric field e3 generally perpendicular to the direction of polarization p1 is established between the strip-shaped section 57-3 and the lower body part 52. The projections 59-3, 61-3 will attempt to shear in first and second directions, respectively, opposite to each other and both normal to the channel 70-3. However, as the projections 59-3, 61-3 are integrally formed with and, therefore, restrained by the body parts 52, 54, respectively, the projection 59-3, and the projection 61-3 will undergo respective shear deformations of 45 degrees to the poling and electric field vectors, deformations which respectively expand the volume of the channel 70-3.

Having described the deflections which actuate a single channel, the operation of the ink jet printhead 50 shall now be discussed. It is contemplated that the ink jet printhead 50 may be operated in various modes. One such mode of operation, referred to as the N=4 mode, may be seen in FIG. **5*b*. In the N=4 mode, the controller 80** generates a sequential (+, −, 0, 0) voltage pattern as illustrated in Table 1 below:

TABLE I

| | T1 | T2 | T3 | T4 |
|---|---|---|---|---|
| 57-1 | 0 | 0 | +1 | −1 |
| 57-2 | −1 | 0 | 0 | +1 |
| 57-3 | +1 | −1 | 0 | 0 |

TABLE I-continued

| | T1 | T2 | T3 | T4 |
|---|---|---|---|---|
| 57-4 | 0 | +1 | −1 | 0 |
| 57-5 | 0 | 0 | +1 | −1 |
| 57-6 | −1 | 0 | 0 | +1 |
| 57-7 | +1 | −1 | 0 | 0 |
| 57-8 | 0 | +1 | −1 | 0 |
| 57-9 | 0 | 0 | +1 | −1 |
| 57-10 | −1 | 0 | 0 | +1 |

Figure 5B:
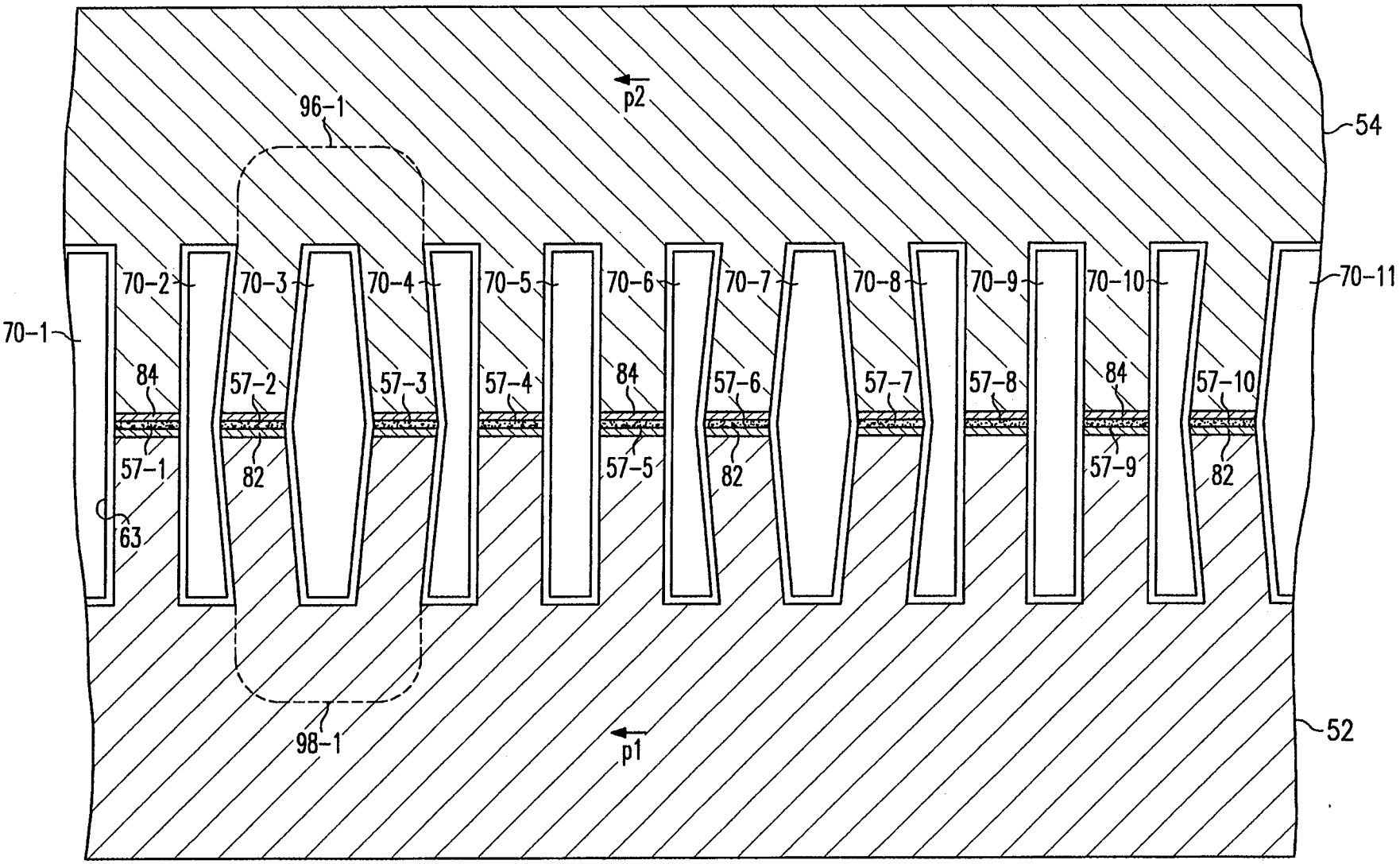
FIG. 5*b* is an enlarged, partial cross-sectional view of the parallel channel array of FIG. 5*a* actuated in a first mode of operation.

In this mode, every fourth channel would fire after the application of voltage during a time period T. To do so, the controller 80 would apply a +1 volt pulse to conductive strips 57-3 and 57-7 and a −1 volt pulse to conductive strips 77-2, 57-6 and 57-10 while keeping conductive strips 57-1, 57-4, 57-5, 57-8 and 57-9 inactive (0 volt). This would create a +2 volt drop across first U-shaped actuator 96 formed between the strips 57-3 and 57-2 and a +2 volt drop across the second U-shaped actuator 98 formed between the strips 57-3 and 57-2. Electric (or "e") fields $\vec{e}1$ and $\vec{e}2$ normal to the direction of polarization $\vec{p}2$ and electric fields $\vec{e}3$ and $\vec{e}4$ normal to the direction of polarization $\vec{p}1$ would be produced, and the projections 59-2 and 59-3, 61-2 and 6-13, 59-6 and 59-7, and 61-6 and 61-7, which form the U-shaped actuators 96-1, 98-1, 96-2, and 98-2, respectively, will attempt to shear in first and second directions, respectively, normal to the channel 70-3, 70-7. Again, as the projections 59-2, 59-3, 61-2, 61-3, 59-6, 59-7, 61-6, 61-7 are integrally formed with, and thus, restrained by, the lower and upper body portions 52, 54, respectively, the projections 59-2, 59-3, 61-2, 61-3, 59-6, 59-7, 61-6, 61-7 will, as illustrated in FIG. 5*b*, deform, in shear, 45 degrees with respect to both the poling and electric field vectors during the positive going segment of the pulse sequence.

As a result, the channels 70-3 and 70-7 defined by the first and second U-shaped actuators 96-1, 98-1 and 96-2, 98-2, respectively, will expand, thereby decreasing the pressure within the respective channel 70-3, 70-7. Since the first and second U-shaped actuators 96-1 and 98-1, as well as the first and second U-shaped actuators 96-2 and 98-2 are constrained together, the pressure drops produced by the respective deflections of the first and second U-shaped actuators 96-1, 98-1, as well as by the first and second U-shaped actuators 98-1, 98-2, are additive. In this manner, a pressure pulse is produced which, after reflection and inversion by a boundary, is reinforced with a compressive pressure pulse, is sufficient to cause the ejection of a droplet of ink from the channels 70-3 and 70-7. The channels 70-1, 70-5 and 70-8 remain passive during this period. While the channels 70-2, 70-4, 70-6, 70-8 and 70-10 receive compressive pressure pulses from U-shaped actuators adjacent thereto, the pressure pulses are exerted by one, rather than both, walls of the channel and are, therefore, insufficient to actuate the channel.

As only every fourth channel is fired simultaneously in the mode described above, very low cross-talk occurs between channels. Accordingly, it is unlikely that a channel will be unintentionally actuated in the N=4 mode. However, depending on the operating parameters, it is anticipated that the rate at which an ink jet printhead operating in the N=4 mode delivers ink may be less than that desired. Accordingly, it is contemplated that the ink jet printhead may be operated in alternate modes typified by both higher delivery rates and higher crosstalk. One such alternate operating mode, referred to as the N=3 mode, is set forth in Table II below:

TABLE II

| | T1 | T2 | T3 |
|---|---|---|---|
| 57-1 | −1 | 0 | +1 |
| 57-2 | +1 | −1 | 0 |
| 57-3 | 0 | +1 | −1 |
| 57-4 | −1 | 0 | +1 |
| 57-5 | +1 | −1 | 0 |
| 57-6 | 0 | +1 | −1 |
| 57-7 | −1 | 0 | +1 |
| 57-8 | +1 | −1 | 0 |
| 57-9 | 0 | +1 | −1 |
| 57-10 | −1 | 0 | +1 |

Figure 5C:
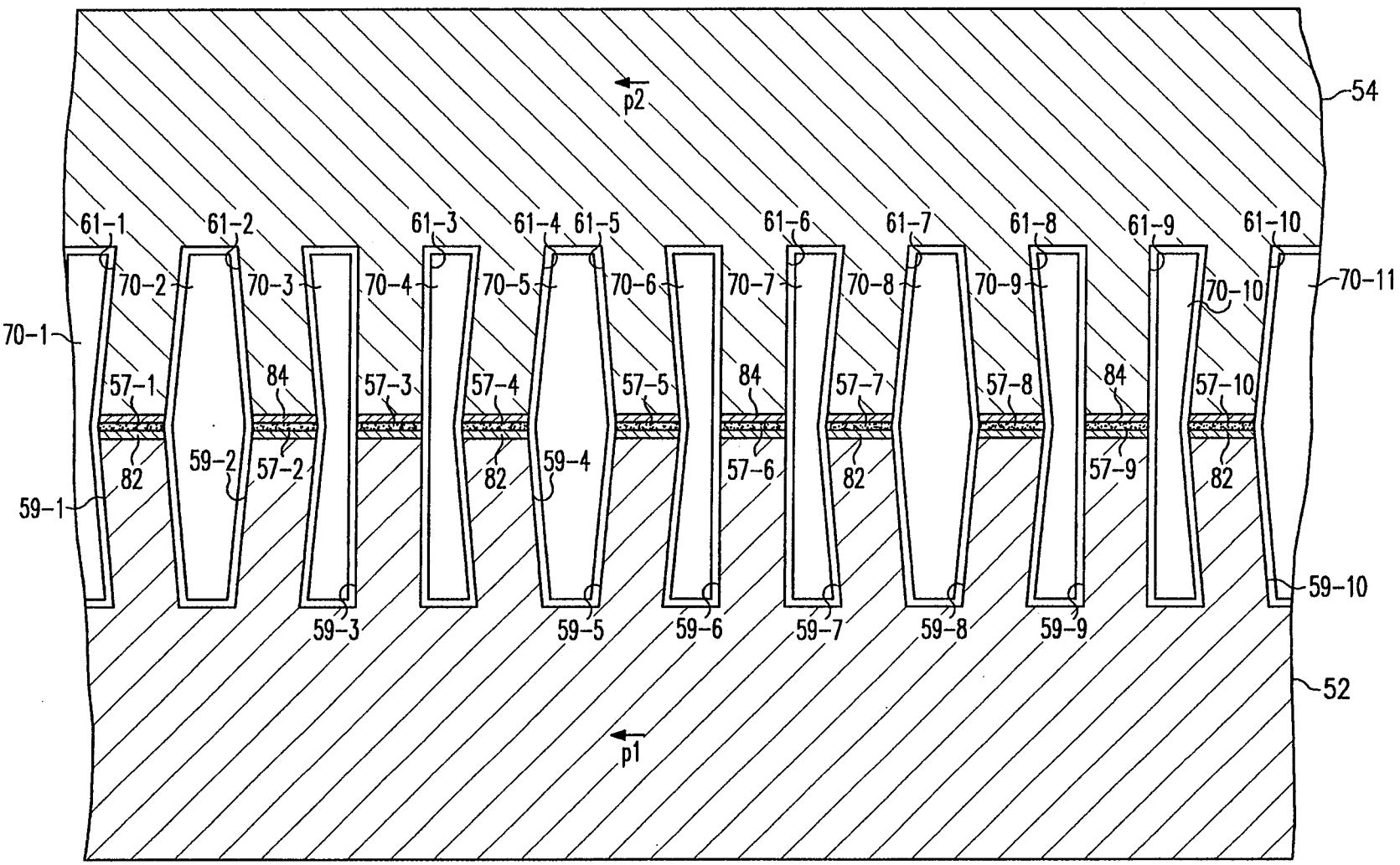
FIG. 5*c* is an enlarged, partial cross-sectional view of the parallel channel array of FIG. 5*a* actuated in a second mode of operation.

In this mode, the controller 80 generates a sequential (−+, 0) voltage pattern in which every third channel would fire after the application of voltage during a time period T. Actuation of an ink jet printhead in this sequence may be seen in FIG. 5*c*. As may be seen in FIG. 5*c*, at T1, the channels 70-2, 70-5, 70-8 and 70-11 are being actuated. All of the remaining channels (70-1, 70-3 70-4, 70-6, 70-7, 70-9 and 70-10) are receiving a compressive pulse which, as previously mentioned, would be insufficient to actuate the channels. As may be seen, ink delivery rate has been increased, although, to do so, more of the inactive channels are receiving pressure pulses, thereby raising the level of cross-talk in the channels.

It is further contemplated that the ink jet printhead may also be operated in yet another alternate mode referred to as the N=2 mode. Here, a (−,+) sequence activates every other channel. While such an operation mode would have the fastest ink delivery rate of the three modes disclosed herein, still higher levels of cross-talk may make the N=2 mode undesirable for certain applications.

While the dimensions of a high density ink jet printhead having a parallel channel array with a U-shaped actuator for each channel may be readily varied without departing from the scope of the present invention, it is specifically contemplated that an ink jet printhead which embodies the present invention may be constructed to have the following dimensions:

| | |
|---|---|
| Orifice Diameter: | 40 μm |
| PZT length: | 15 mm |
| PZT height: | 120 μm |
| Channel height: | 356 μm |
| Channel width: | 91 μm |
| Sidewall width: | 81 μm |

Figure 6A:
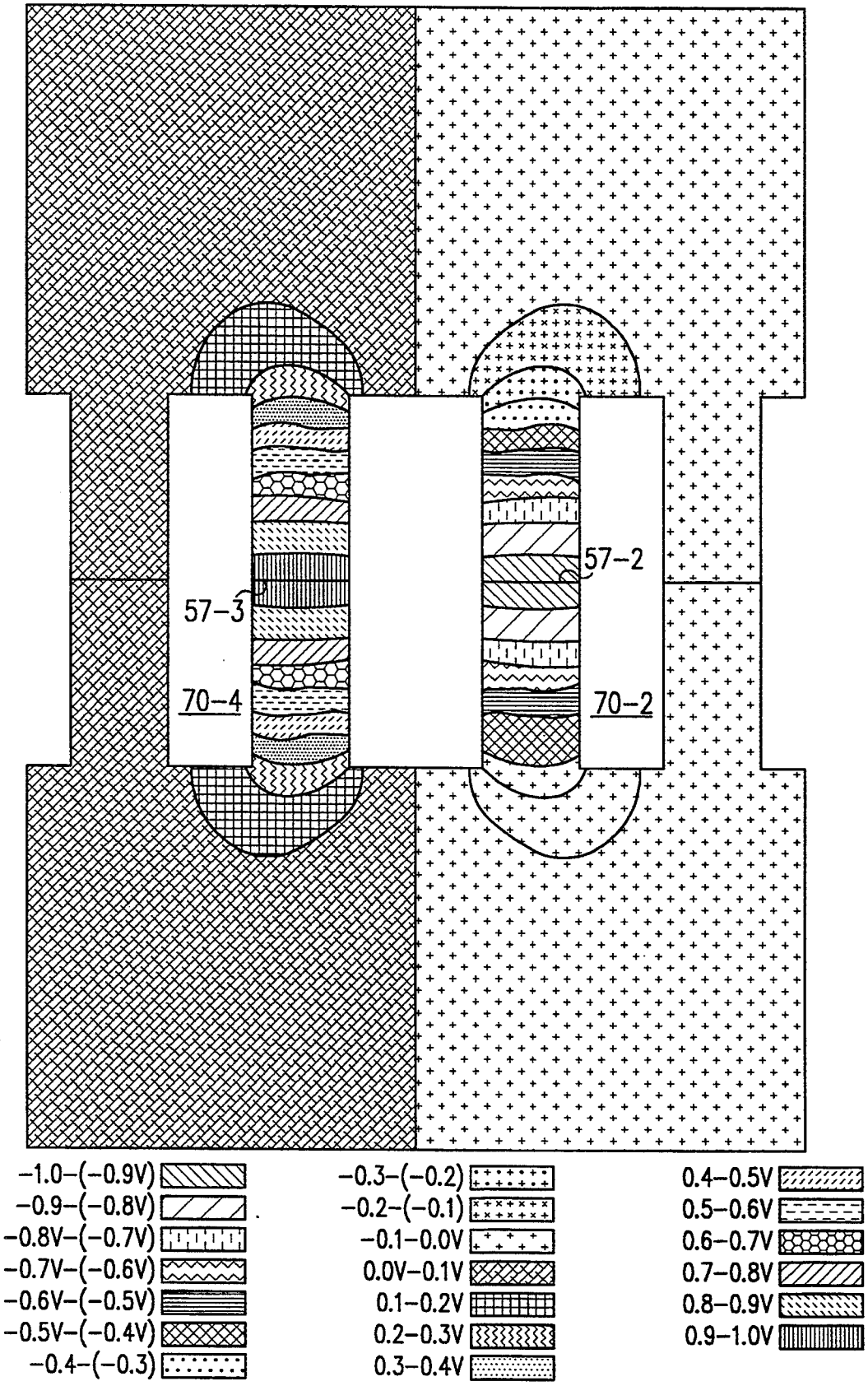
FIG. 6*a* illustrates the voltage distribution for a portion of the actuated parallel channel array of FIG. 5*b;*
Figure 6B:
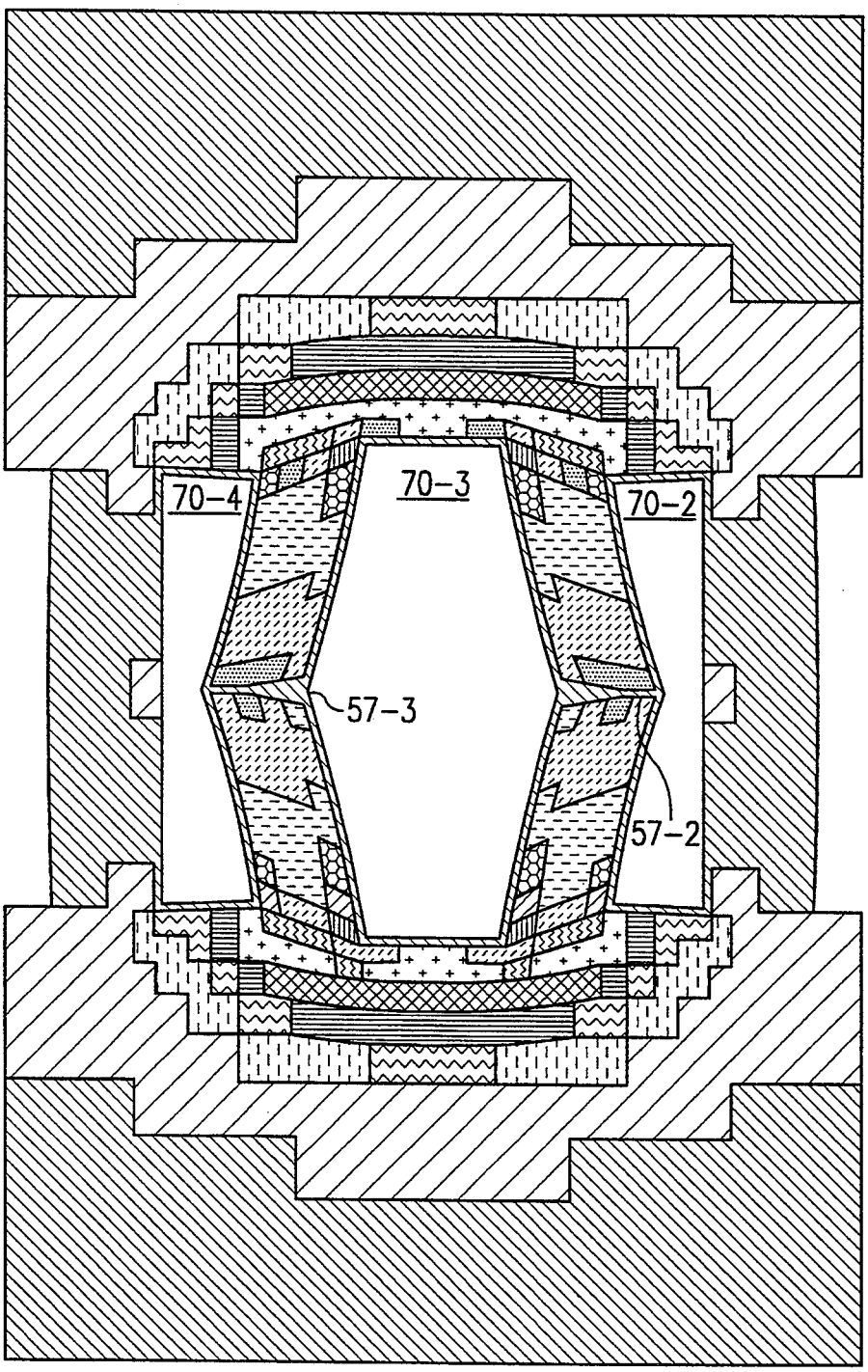
FIG. 6*b* illustrates the electric field displacement for a portion of the actuated parallel channel array of FIG. 5*b*.
Figure 6B:
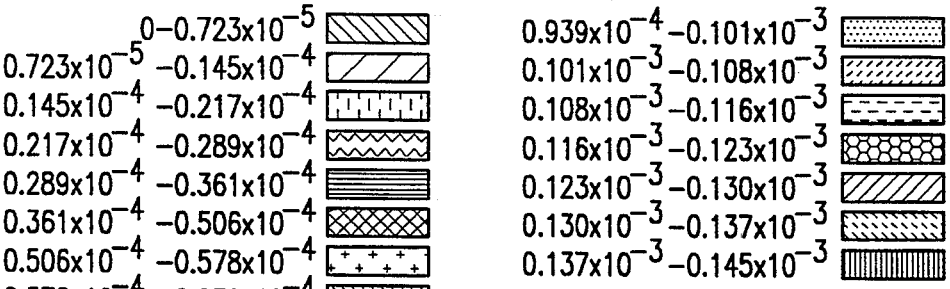
Figure 6C:
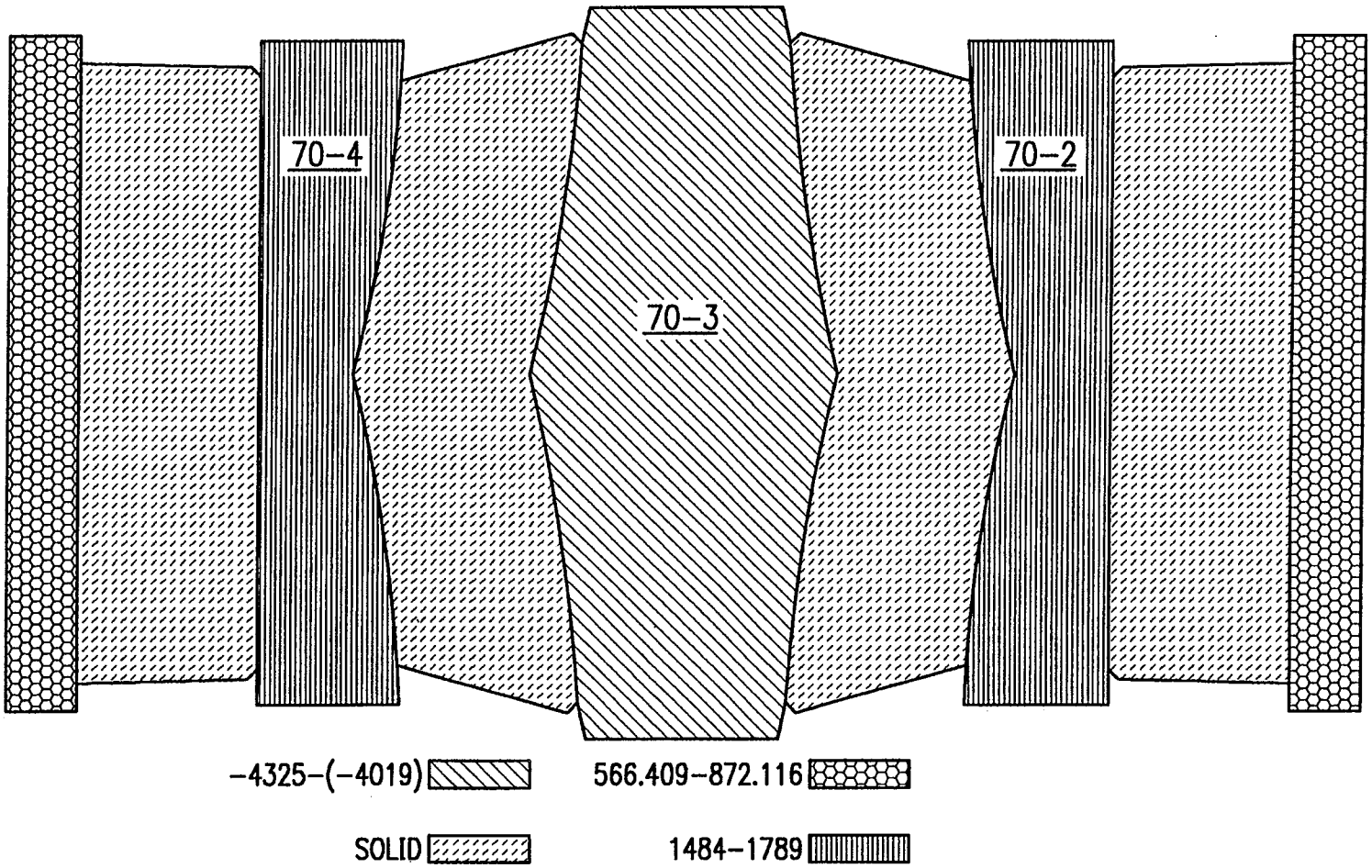
FIG. 6*c* illustrates the pressure distribution for a portion of the actuated parallel channel array of FIG. 5*b*.

Referring next to FIGS. 6*a–c*, a graphical analysis of the operation of the ink jet printhead 50 with first and second U-shaped actuators for each channel, as viewed from the opposite, or back end, of the ink jet printhead 50 may now be seen. Specifically, FIGS. 6*a–c* analyze the performance of an ink-carrying channel when actuated by the first and second U-shaped actuators defining the channel. FIG. 6*a* illustrates the voltage distribution for a portion of the ink jet printhead 50 when a +1 volt charge is placed on the conductive strip-shaped section 57-3 and a −1 volt charge is placed on the conductive strip-shaped section 57-2, thereby creating approximately 1 volt drops between the strip-shaped section 57-2 and the non-projecting portion of the lower and top body parts 52, 54, respectively approximately a 1 volt drop between the strip-shaped section 57-3 and the non-projecting portion of the lower and top body parts 52, 54, respectively and approximately a two volt drop between the strip-shaped sections 57-2 and 57-3. In FIG. 6*b*, the electric field distribution which corresponds to the voltage distribution of FIG. 6*a* is shown.

In FIG. 6*c*, the pressure distribution is illustrated. As may be seen here, the pressure produced in the actuated channel 70-3 ranges between 4019 Pa/Volt and 4325 Pa/Volt expansive pressure. In contrast, the compressive pressure produced in the unactuated channels 70-2 and 70-4 ranges between 1484 and 1789 Pa/Volt, a level which, as previously stated, is insufficient to actuate the channels. In inactive channels 70-1 and 70-5, the compressive pressure produced ranged between 566 and 872 Pa/Volt. Thus, relatively low levels of tooth-to-tooth and channel-to-channel cross-talk well below that which would inadvertently cause the ejection of a droplet of ink in a channel other than those actuated.

The pressure produced in the ink jet printhead 50 using first and second U-shaped actuators, the so-called "double-U" configuration, to fire an ink-carrying channel compares favorably with the 4100 Pa/Volt produced in an actuated channel ink jet printhead having a single U-shaped actuator (the "single-U" configuration) such as that disclosed in our prior application Ser. No. 07/746,521 filed Aug. 16, 1991. The similarity in performance is the result of two offsetting effects. The maximum electric displacement in a double-U configuration is less than that in a single-U configuration because the ground plane at the top of the sidewalls has been removed. As may be seen in FIG. 6*a*, the voltage at the main body portion of the printhead ranges between 0.0−+/−0.1 volt. In contrast, the use of an active thin piece of PZT as an intermediate section of a sidewall resulted in the single-U configuration having a connection to ground at the end of the sidewalls. As a result, the voltage drop between the center and end of the sidewall is greater for a single-U configuration in comparison with a double-U configuration. This contributes to a more powerful distortion of the sidewall and, therefore, greater compressive pressure in the channels. On the other hand, in the double-U configuration, the upper part of the sidewall is integrally formed with the top body part. In contrast, the single-U configuration required the use of a thin piece of PZT as an intermediate section of the sidewall. In turn, the thin piece of PZT required the use of an adhesive strip to mount it to the main body of the printhead. As a result, a distortion of the upper portion of the sidewall in a double-U configuration is translated into greater mechanical displacement as compared to a similar distortion of a single-U configuration where the intermediate section tended to "float" or slide on the adhesive strip. For this reason, the sidewalls the single-U configuration tend to produce less mechanical displacement.

It should be noted, however, that while these offsetting effects cause the single-U and double-U configurations to perform similarly, certain external considerations make the double-U configuration more desirable for use. Specifically, by going to the double-U configuration for an ink jet printhead, the need for the thin PZT component, which typically would be between 100–200 micrometers thick and have dimensions in the range of 4–8 mils, the fabrication of which has proven both difficult and expensive, is eliminated.

The foregoing detailed description is to be clearly understood as being given by way of illustration and example only, the spirit and scope of the present invention being limited solely by the appended claims.

What is claimed is:

1. An ink jet printhead, comprising:

a lower body part formed from a piezoelectric material, said lower body part having a base section and a plurality of generally parallel spaced projections extending longitudinally along said base section and upwardly therefrom, each of said projections having a top side;

an upper body part formed from a piezoelectric material, said upper body part having a top section and a corresponding plurality of generally parallel spaced projections extending longitudinally along said top section and downwardly therefrom, each of said projections having a bottom side;

said top sides of said lower body projections and said bottom sides of said corresponding upper body projections conductively mounted together to define a plurality of generally parallel, axially extending ink-carrying channels from which ink may be ejected therefrom;

means for generating a first electric field which extends from said top side of a first one of said lower body projections to said top side of a second one of said lower body projections adjacent to said first one of said lower body projections; and means for generating a second electric field which extends from said bottom side of a first one of said upper body projections mounted to said first one of said lower body projections to said bottom side of a second one of said upper body projections mounted to said second one of said lower body projections.

2. An ink jet printhead according to claim 1 wherein said lower body part is poled in a first direction generally perpendicular to the direction of axial extension of said plurality of parallel channels.

3. An ink jet printhead according to claim 2 wherein said upper body part is also poled in said first direction.

4. An ink jet printhead, comprising:

a lower body part formed from a piezoelectric material, said lower body part having a base section and a plurality of generally parallel spaced projections extending longitudinally along said base section and upwardly therefrom, each of said projections having a top side;

an upper body part formed from a piezoelectric material, said upper body part having a top section and a corresponding plurality of generally parallel spaced projections extending longitudinally along said top section and downwardly therefrom, each of said projections having a bottom side;

said top sides of said lower body projections and said bottom sides of said corresponding upper body projections mounted together to define a plurality of generally parallel, axially extending ink-carrying channels from which ink may be ejected therefrom; and a corresponding plurality of strip-shaped sections of a layer of conductive adhesive, each of said strip-shaped sections conductively mounting one of said projections of said lower body part to said corresponding one of said projections of said upper body part.

5. An ink jet printhead according to claim 4 and further comprising a controller electrically connected to each of said plurality of strip-shaped sections of said layer of conductive adhesive, said controller configured to simultaneously impart either a positive, a zero, or a negative voltage to each of said strip-shaped sections of conductive adhesive.

6. An ink jet printhead according to claim 5 and wherein said controller imparts said positive, zero and negative voltages in a pattern which simultaneously activates every third channel.

7. An ink jet printhead according to claim 4 and wherein each of said ink-carrying channels is coated with a layer of a dielectric material.

8. An ink jet printhead according to claim 4 wherein said lower body part is poled in a first direction generally perpendicular to the direction of axial extension of said plurality of parallel channels.

9. An ink jet printhead according to claim 8 wherein said upper body part is also poled in said first direction.

10. An ink jet printhead, comprising:

a lower body part formed from a piezoelectric material, said lower body part having a base section and a plurality of generally parallel spaced projections extending longitudinally along said base section and upwardly therefrom, each of said projections having a top side; and an upper body part formed from a piezoelectric material, said upper body part having a top section and a corresponding plurality of generally parallel spaced projections extending longitudinally along said top section and downwardly therefrom, each of said projections having a bottom side;

said top sides of said lower body projections and said bottom sides of said corresponding upper body projections conductively mounted together to define a plurality of generally parallel, axially extending ink-carrying channels from which ink may be ejected therefrom;

wherein each of said ink-carrying channels is defined by a pair of adjacent lower body projections, a segment of said bottom section between said pair of adjacent lower body projections, a corresponding pair of adjacent upper body projections, a segment of said top section between said pair of adjacent upper body projections and first and second strip-shaped sections of a layer of conductive adhesive which mount each of said pair of lower body projections to the corresponding one of said pair of upper body projections.

11. An ink jet printhead according to claim 10 wherein said lower body part is poled in a first direction generally perpendicular to the direction of axial extension of said plurality of parallel channels and said upper body part is also poled in said first direction.

12. An ink jet printhead according to claim 11 and further comprising means for generating first and second electric field across each of said pair of lower body part projections, respectively, said first and second electric fields being generally perpendicular to said direction of poling of said lower body part and in first and second directions opposite to each other.

13. An ink jet printhead according to claim 12 and further comprising means for generating third and fourth electric fields across each of said pair of upper body part projections, respectively, said third and fourth electric fields being generally perpendicular to said direction of poling of said upper body part and in third and fourth directions opposite to each other.

14. An ink jet printhead, comprising:

a first generally U-shaped actuator having first and second top walls;

a second generally U-shaped actuator having first and second bottom walls conductively mounted to said first and second top walls of said first generally U-shaped actuator;

means for generating a first electric field which extends from said first top wall of said first U-shaped actuator to said second top wall of said first U-shaped actuator; and means for generating a second electric field which extends from said first bottom wall of said second U-shaped actuator to said Second bottom wall of said second U-shaped actuator;

wherein said first and second generally U-shaped actuators define a elongated liquid confining channel.

15. An ink jet printhead according to claim 14 and further comprising means for electrically connecting said first and second U-shaped actuators for the selective application of a first pressure pulse to said elongated liquid confining channel.

16. An ink jet printhead, comprising:

a first generally U-shaped actuator having first and second top walls;

a second generally U-shaped actuator having first and second bottom walls;

a first strip of conductive adhesive for conductively mounting said first top wall of said first U-shaped actuator to said first bottom wall of said second U-shaped actuator; and a second strip of conductive adhesive for conductively mounting said second top wall of said second U-shaped actuator to said second bottom wall of said second U-shaped actuator;

wherein said first and second generally U-shaped actuators define a elongated liquid confining channel.

17. An ink jet printhead according to claim 16 and further comprising:

means for selectively applying a positive voltage to said first strip of conductive adhesive; and means for selectively applying a negative voltage to said second strip of conductive adhesive.

18. An ink jet printhead according to claim 16 wherein said first U-shaped actuator is formed from a piezoelectric material poled in a first direction generally perpendicular to the direction of said elongated liquid confining channel and said second U-shaped actuator is formed from a piezoelectric material also poled in said first direction.

19. An ink jet printhead according to claim 18 wherein said first U-shaped actuator is comprised of a first projecting member which terminates in said first top surface and a second projecting member which terminates in said second top surface, said first and second projecting members being generally parallel to each other and integrally formed with a common base member and wherein said means for selectively applying a positive voltage to said first strip of conductive adhesive and said means for selectively applying a negative voltage to said second strip of conductive adhesive produce first and second electric fields, oppositely orientated to each other, in said first and second projecting members, respectively.

20. An ink jet printhead according to claim 19 wherein said second U-shaped actuator is comprised of a first projecting member which terminates in said first bottom surface and a second projecting member which terminates in said second bottom surface, said first and second projecting members being generally parallel to each other and integrally formed with a common top member and wherein said means for selectively applying a positive voltage to said first strip of conductive adhesive and said means for selectively applying a negative voltage to said second strip of conductive adhesive produce third and fourth electric fields, oppositely orientated to each other, in said first and second projecting members, respectively.

21. An ink jet printhead according to claim 20 wherein said first projecting members of said first and second U-shaped actuators form a first sidewall of said elongated liquid confining channel and said second projecting members of said first and second U-shaped actuators form a second sidewall of said elongated liquid confining channel, said first sidewall deforming in a first direction which expands said channel when said positive voltage is applied to said first strip and said second sidewall deforming in a second direction which expands said channel when said negative voltage is applied to said second strip.

* * * * *